US007396187B1

(12) United States Patent
Meyers

(10) Patent No.: US 7,396,187 B1
(45) Date of Patent: Jul. 8, 2008

(54) UPRIGHT TROWEL

(75) Inventor: Lawrence G. Meyers, Layton, UT (US)

(73) Assignee: Beno J. Gundiach Company, Layton, UT (US)

( * ) Notice: Subject to any disclaimer, the term of this patent is extended or adjusted under 35 U.S.C. 154(b) by 0 days.

(21) Appl. No.: 11/342,347

(22) Filed: Jan. 26, 2006

Related U.S. Application Data

(60) Provisional application No. 60/647,651, filed on Jan. 26, 2005.

(51) Int. Cl.
*E01C 19/24* (2006.01)

(52) U.S. Cl. ..... 404/118; 16/110.1

(58) Field of Classification Search ..... 404/118; 16/110, 405–409, 141, 422, 427
See application file for complete search history.

(56) References Cited

U.S. PATENT DOCUMENTS

| | | | | | |
|---|---|---|---|---|---|
| 842,770 | A | | 1/1907 | Connelly | |
| 872,903 | A | | 12/1907 | Connelly | |
| 988,457 | A | | 4/1911 | Glasscock | |
| 1,021,557 | A | | 3/1912 | Runner | |
| 1,713,513 | A | | 5/1929 | Abram | |
| 2,834,199 | A | | 5/1958 | Freeman | |
| 2,999,261 | A | * | 9/1961 | Lapham | 15/235.8 |
| 3,146,481 | A | * | 9/1964 | Chiuchiarelli | 15/235.8 |
| 3,729,765 | A | | 5/1973 | Peterson | |
| 3,798,701 | A | | 3/1974 | Irwin et al. | |
| 3,803,662 | A | | 4/1974 | Glejf | |
| 4,397,581 | A | * | 8/1983 | Jarvis | 404/97 |
| 4,520,527 | A | | 6/1985 | Maggio et al. | |
| 4,641,995 | A | * | 2/1987 | Owens | 404/118 |
| 4,702,641 | A | * | 10/1987 | Naser et al. | 404/97 |
| 4,892,437 | A | * | 1/1990 | Kraft | 404/97 |
| 4,982,470 | A | | 1/1991 | Szabo | |
| 5,115,536 | A | | 5/1992 | Jarvis | |
| 5,379,479 | A | * | 1/1995 | Nelson | 15/245.1 |
| 5,393,168 | A | * | 2/1995 | Jarvis | 404/97 |
| 5,609,437 | A | * | 3/1997 | Silva | 404/118 |
| 5,737,795 | A | * | 4/1998 | Murders | 15/235.4 |
| 5,836,040 | A | | 11/1998 | Giacomelli | |
| 5,857,803 | A | * | 1/1999 | Davis et al. | 404/102 |
| 5,946,762 | A | | 9/1999 | Dionisio | |
| 6,379,080 | B1 | * | 4/2002 | Saffo, Sr. | 404/118 |
| 6,412,138 | B1 | * | 7/2002 | MacMillan | 15/144.2 |
| 6,550,214 | B2 | | 4/2003 | Aguilera | |
| 6,779,945 | B2 | * | 8/2004 | Saffo, Sr. | 404/118 |
| 2003/0031510 | A1 | * | 2/2003 | Suriano | 404/118 |

* cited by examiner

*Primary Examiner*—Raymond W Addie
(74) *Attorney, Agent, or Firm*—Thorpe North & Western LLP

(57) ABSTRACT

A trowel device for use by an operator in an upright position comprises a trowel blade receiving assembly and a first elongate handle section, operably coupled to and extending away from the blade receiving assembly toward a proximal end of the device. A second elongate handle section is rotatably fixable with respect to the first elongate handle section and extends away from the blade receiving assembly toward the proximal end of the device. The first handle section is rotatable with respect to the second handle section about a longitudinal axis common to each of the handle sections to allow the operator to adjust an angle of a trowel blade of the trowel blade receiving assembly while the operator is an upright position.

10 Claims, 8 Drawing Sheets

UPRIGHT TROWEL

Priority is claimed of copending U.S. Provisional Patent Application Ser. No. 60/647,651, filed Jan. 26, 2005, which is hereby incorporated herein in its entirety.

BACKGROUND OF THE INVENTION

1. Field of the Invention

The present invention relates generally to trowels for use in flooring installation. More particularly, the present invention relates to trowels that are used by an operator while the operator is in a generally upright orientation.

2. Related Art

Installation of flooring materials, such as vinyl flooring and some types of carpeting, often requires application of adhesive material to the floor area over which the flooring is to be installed. Adhesive materials are most often applied by heaping a large portion of adhesive in a central location and spreading the adhesive outwardly with a hand trowel that includes toothed depressions through which the adhesive passes to ensure consistent coverage of the adhesive. Hand trowels generally require that the operator kneel in position adjacent the adhesive and move, on hands and knees, in one or more directions as the adhesive is spread. The physical toll taken on the knees, legs and backs of operators from kneeling while spreading adhesive can result in significant discomfort during the adhesive application process and/or in significant injury resulting therefrom.

In an effort to address the problems associated with the use of hand trowels in flooring applications, trowels have been developed that purport to enable an operator to use the trowel while in a standing, upright position. While such upright trowels have addressed some of the problems discussed above, they have proved unsuccessful in that merely adding an elongate handle to an ordinary hand trowel results in a trowel that cannot be manipulated by the operator with enough precision to allow suitable coverage of the adhesive.

In other cases, attempts have been made to add control to the trowel in variety of manners, for example, by allowing adjustment, from an upright position, of tilt of the trowel blade relative to the handle and/or twist of the trowel blade relative to the handle. However, such attempts have resulted in upright trowels that are overly bulky and difficult to transport and store. In addition, such conventional upright trowels generally include components that are easily damaged when transported or stored in utility vehicles, and that can become easily fouled with adhesive materials during the adhesive application process.

SUMMARY OF THE INVENTION

It has been recognized that it would be advantageous to develop an upright trowel that can be easily and accurately manipulated by an operator while in an upright position, and that includes operable components which are protected from damage and contamination.

The invention provides a trowel device for use by an operator in an upright position, including a trowel blade receiving assembly and a first elongate handle section, operably coupled to and extending away from the blade receiving assembly toward a proximal end of the device. A second elongate handle section can be rotatably fixable with respect to the first elongate handle section and can extend away from the blade receiving assembly toward the proximal end of the device. The first handle section can be rotatable with respect to the second handle section about a longitudinal axis common to each of the handle sections to allow the operator to adjust an angle of a trowel blade of the trowel blade receiving assembly while the operator is an upright position.

In accordance with another aspect of the invention, a trowel device for use by an operator in an upright position is provided, including a trowel blade receiving assembly and an elongate handle section, extending away from the blade receiving assembly toward a proximal end of the device. A flexible joint can be operatively coupled between the elongate handle section and the trowel blade receiving assembly. The flexible joint can provide rotatability to the trowel blade receiving assembly about an axis of rotation disposed at an angle to an axis of the elongate handle section. A joint enclosure can at least partially enclose the flexible joint. The joint enclosure can be configured to contain the joint to allow the joint to rotate within the enclosure while protecting the joint from contact with adverse materials.

In accordance with another aspect of the invention, a method of spreading flooring material from an upright position is provided, including: engaging flooring material disposed on a flooring surface with a trowel blade coupled to an upright trowel device; grasping a first elongate handle section of the upright trowel device to thereby control an angle between a handle of the trowel device and the flooring surface; and grasping and rotating a second elongate handle section of the upright trowel device to thereby alter a relative angle between the trowel blade and the handle of the trowel blade device. The first and second elongate handle sections can be rotatable with respect to one another about a common longitudinal axis to allow rotation of the trowel blade by an operator in an upright position.

Additional features and advantages of the invention will be apparent from the detailed description which follows, taken in conjunction with the accompanying drawings, which together illustrate, by way of example, features of the invention.

DETAILED DESCRIPTION

Figure 1:
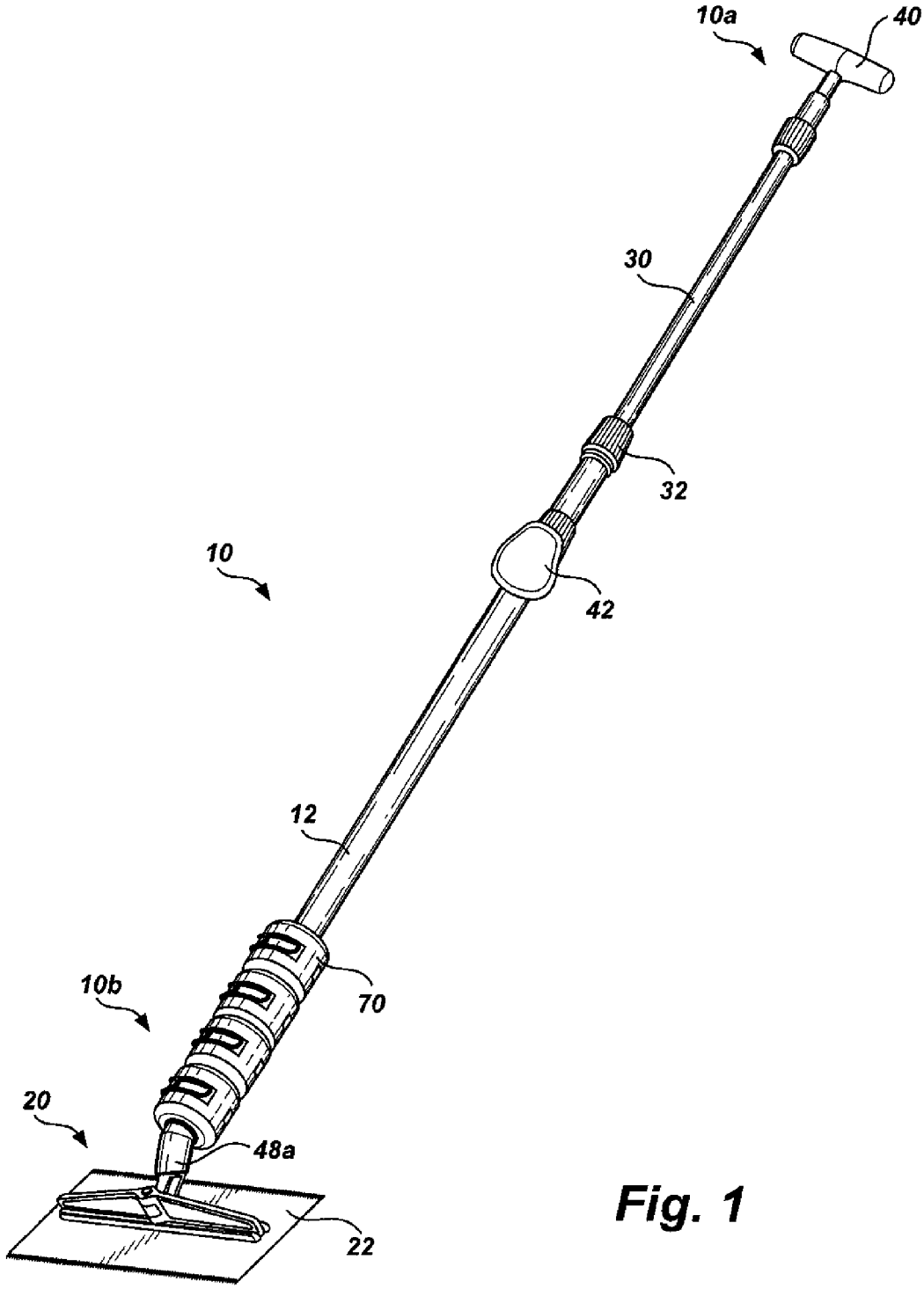
FIG. 1 is a perspective view of an upright trowel in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, a system, indicated generally at 10, in accordance with the present invention is provided for an upright trowel device. The trowel device (hereinafter sometimes referred to as "the trowel") can be used in a variety of flooring applications and is particularly well suited for applying adhesive or other floor treating compounds to a flooring surface while the operator (not shown) maintains an upright orientation.

As the trowel can be used while the operator maintains a generally upright position or orientation, fatigue and injury resulting from an operator having to spread or apply materials with a trowel while in a kneeling orientation are considerably reduced, if not eliminated entirely. The present trowel provides several advantages over conventional upright trowel systems. For example, as the majority of moving components of the trowel are essentially contained within an outer casing, the moving components are much less susceptible to damage from physical contact with external devices, and from becoming fouled with adhesive, water or other materials. Also, the trowel can be operated equally effectively by right- or left-handed operators. In addition, angular adjustments can be made to the trowel blade of the trowel with much more precision than with conventional devices, resulting in a more precise, higher quality operation.

As a preliminary matter, when used herein, the terms "proximal" and "distal" are to be understood to refer to locations relative to a center of an operator wielding the trowel assembly. Thus, the term "proximal" is to be understood to refer to an element that is relatively closer to the operator, when the trowel is in normal operation, than is an element referred to as "distal."

Figure 4:
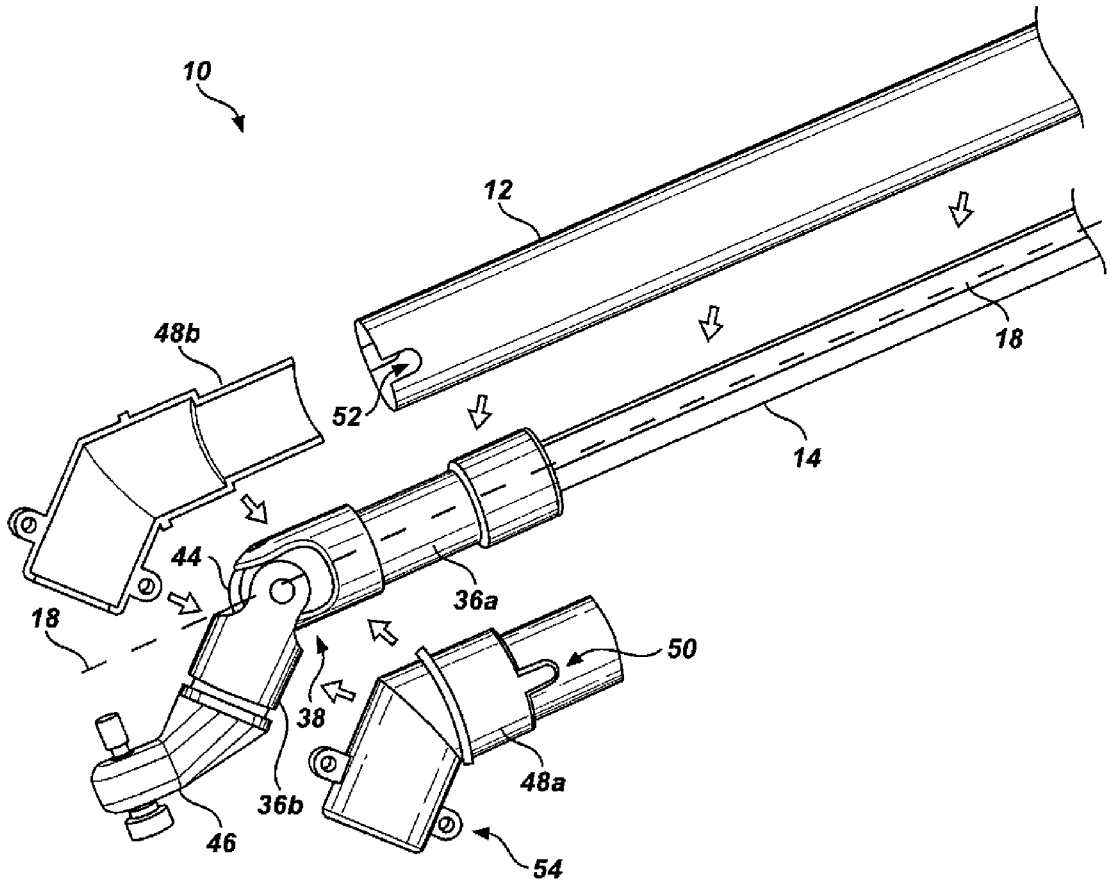
FIG. 4 is a partially exploded view of a flexible joint of the upright trowel of FIG. 1.

As shown in perspective view in FIG. 1 and in more detailed, exploded view in FIG. 4, the trowel 10 generally includes a trowel blade receiving assembly 20 and a first elongate handle section 14 (FIG. 4), operably coupled to and extending away from the receiving assembly toward a proximal end 10*a* of the device. A second elongate handle section 12 can be rotatably fixable with respect to the first elongate handle section and can extend away from the receiving assembly toward the proximal end of the trowel. The first handle section can be rotatable with respect to the second handle section about a longitudinal axis 18 (FIG. 4) common to each of the handle sections. In this manner, an operator can adjust an angle of a trowel blade 22 of the trowel blade receiving assembly while the operator is an upright position.

In one embodiment of the invention, one of the first 14 and second 12 elongate handle sections can extend at least partially through another of the first and second elongate handle sections. Thus, in the example shown in FIGS. 1 and 4, the first, inner elongate handle section is encompassed by the second, outer elongate handle section. As the first handle section is turned by an operator (via upper handle 40, as discussed in more detail below), the trowel blade receiving assembly 20 is caused to rotate about one or more axes of rotation to enable the operator to control the angle of the blade 22 relative to a flooring surface (not shown).

It will be appreciated that application of force to the upper handle 40, while a lower handle 42 is maintained in position, results in a torsional force differential being created between the two handle sections along the common longitudinal axis 18. By disposing upper handle 40 and lower handle 42 closely adjacent to the common longitudinal axis 18, the amount of torque required to be applied by the operator in maintaining the position of the lower handle while the upper handle is twisted can be minimized.

In addition, the configuration of the handles 40, 42 and the collinear handle sections 12, 14 results in an upright trowel that can be easily and accurately manipulated by operators who are either right- or left-handed. As an example, a typical right-handed operator would grasp the lower handle 42 with his or her left hand and grasp and twist the upper handle 40 with his or her right hand. The operator would then position the trowel blade 22 ahead of a pool or aggregate of adhesive or other flooring material (not shown) (e.g., the pool of adhesive would be positioned between the trowel blade and the operator's body) adjacent the distal end 10*b* of the trowel. The operator would then pull the trowel backwardly as the operator manipulated the trowel blade across and over the flooring surface to evenly spread the adhesive across the flooring surface. In most applications, the trowel blade is moved backwardly and in a side-to-side motion to allow the operator to spread adhesive in a swath that is wider than the width of the trowel blade.

As with conventional trowel blades, the trowel blade 22 can include a series of teeth 23 which define valleys therebetween which allow only a limited amount of adhesive to be extruded through the valleys as the trowel blade is moved across the floor. As the edge of the trowel must generally be maintained in constant, even contact with the flooring surface for this application to be done accurately, it is important that the operator be able to carefully and accurately control the angle of the trowel blade.

Figure 8:
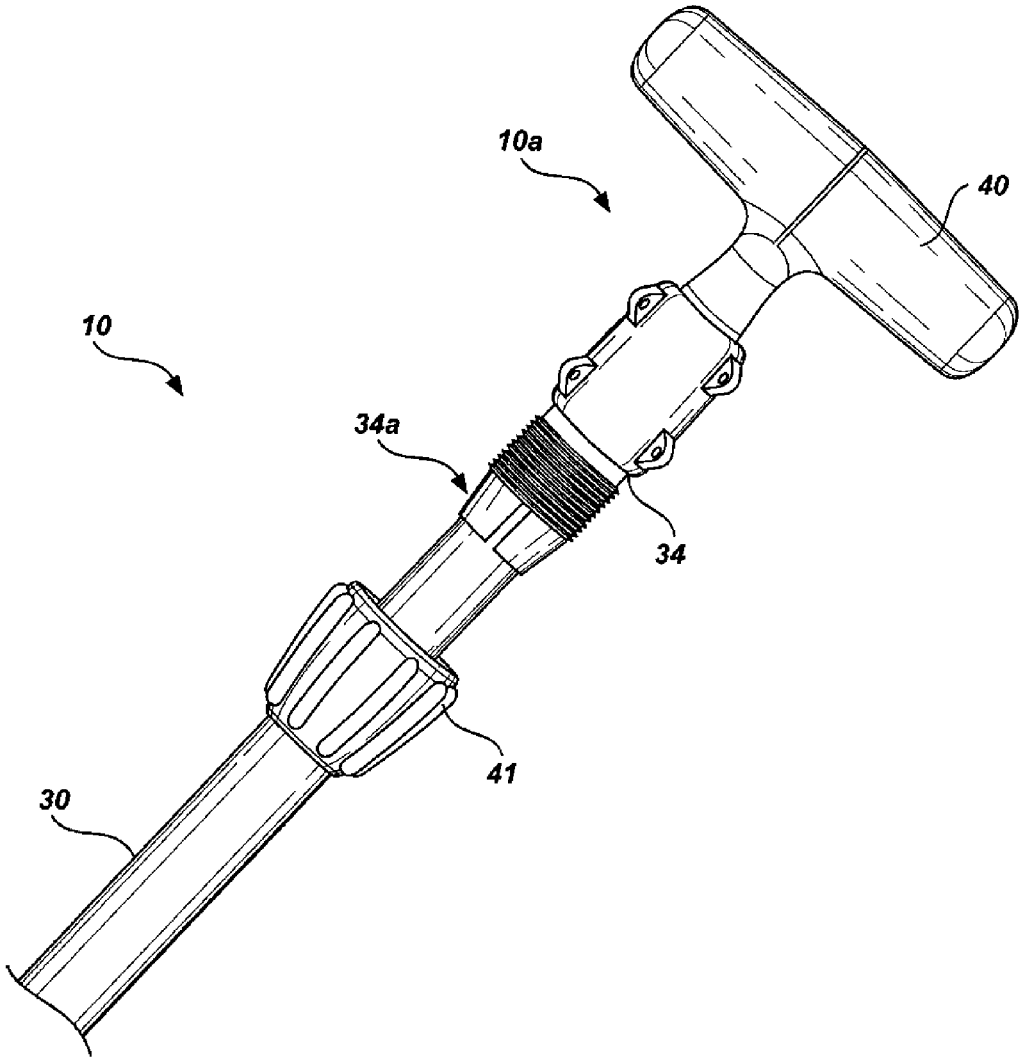
FIG. 8 is a partially exploded view of a proximal end of the upper handle section of the upright trowel of FIG. 1.

Control of the trowel blade 22 of the trowel 10 is accomplished by the operator twisting upper handle 40. As shown in FIG. 8, in one aspect of the invention, upper handle 40 can be rigidly connected to upper handle portion 30 of the trowel by way of a threaded nut 41 which engages notched receiver 34. Engagement of the threaded nut onto the threads of the receiver result in compression of the notches 34*a* of the receiver 34, which in turn causes the notches 34*a* to tighten about the upper handle portion to thereby cinch the upper handle to the upper handle portion.

Figure 5:
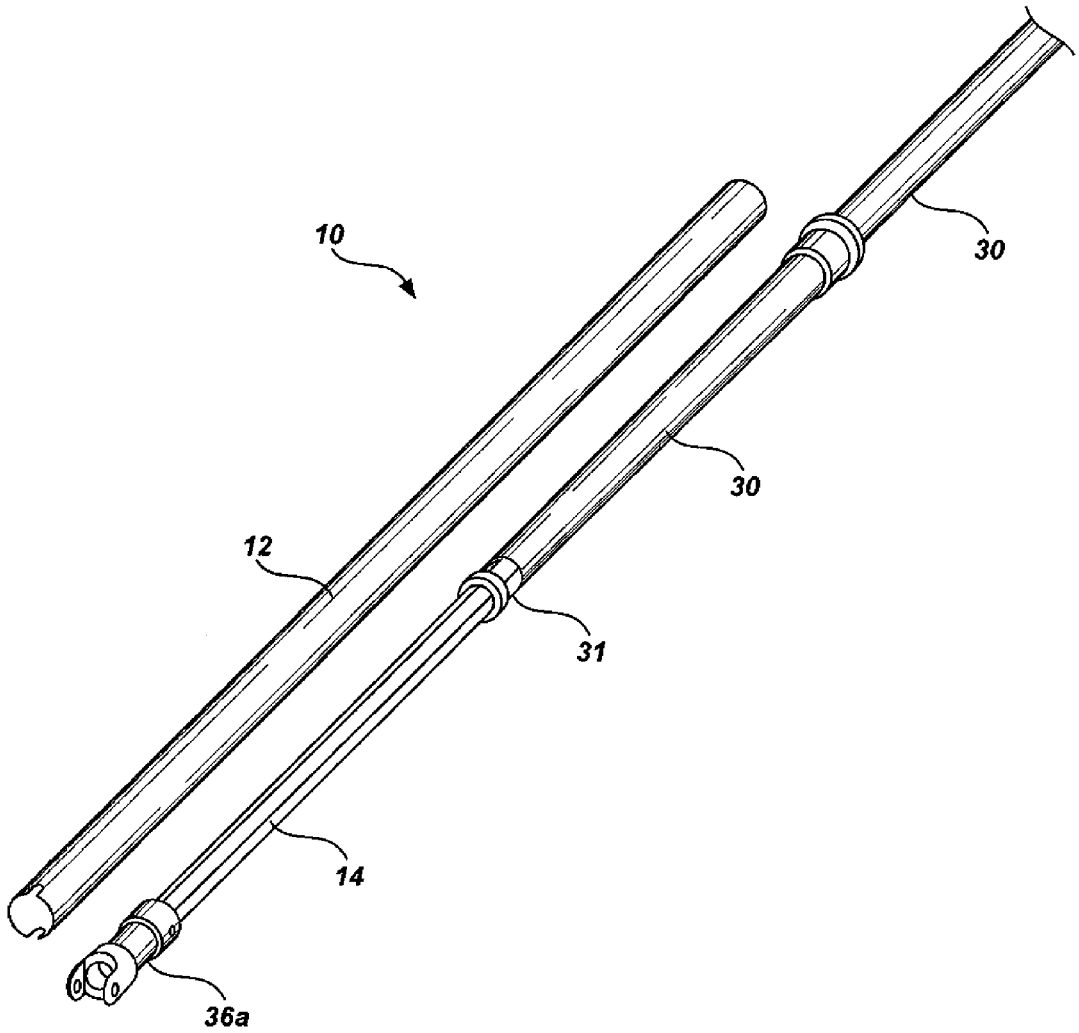
FIG. 5 is a partially exploded view of a lower portion of a handle of the upright trowel of FIG. 1.

As shown in FIG. 5, the upper handle portion 30 can extend downwardly to lower, inner handle section 14 where the two can overlap and engage one another to limit rotation of one relative to another (e.g., upper handle portion 30 can serve as an extension of lower handle section 14). The overlapping relationship also allows the upper handle portion and the lower, inner handle section to be adjusted longitudinally with respect to one another to allow an operator to lengthen or shorten an overall length of the trowel device to adjust the trowel for optimal use by a particular operator. Connecting collar 31 can include a set screw (not shown), or similar structure to secure the lower handle section 14 and the upper handle portion 30 relative to one another.

Figure 6:
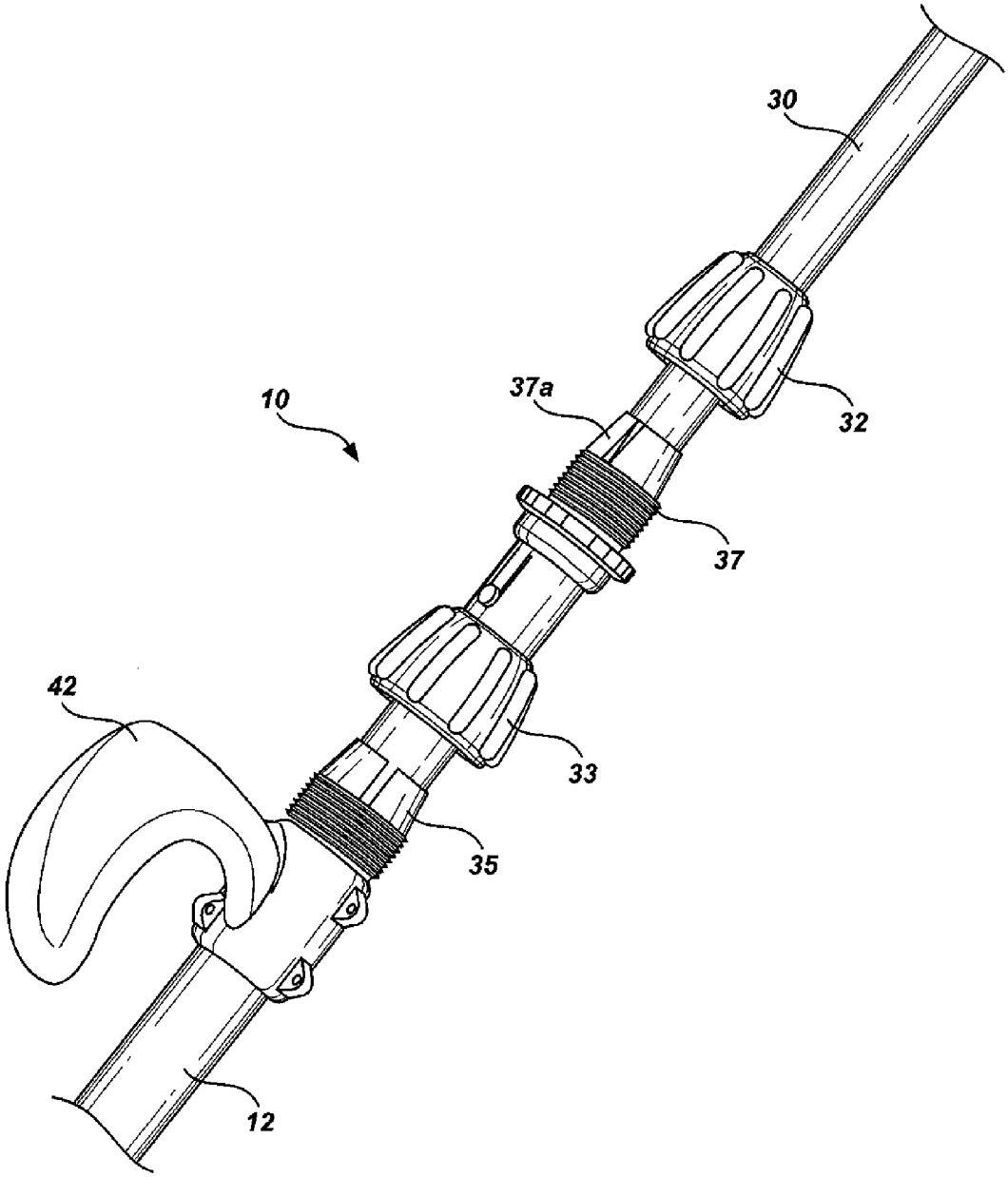
FIG. 6 is a partially exploded view of an interface section of upper and lower handle portions of the handle of the upright trowel of FIG. 1.

Adjustment of an overall length of the trowel device 10 can also be provided by allowing connecting collar 31 to slide freely along the lower handle section 14 (while being restricted from rotating relative to the lower handle section by the hexagonal engagement portions of the collar). In this manner, the upper portion 30 of the handle can be telescopically adjustable relative to the lower section 14. As shown in FIG. 6, securing collar 37 can be attached to a proximal end of the outer, lower handle section 12 and can include fingers or engagement portions 37*a* that can be tightened against the upper handle portion 30 by nut 32. Thus, in order to adjust an overall length of the trowel device 10, nut 32 can be loosened from about finger portions 37*a* of collar 37 and the upper portion can be extended or retracted over handle section 14. Once a desired length is obtained, the nut can be tightened over the collar 37 to secure the upper portion 30 relative to the lower portion 14.

As shown in FIGS. 4 and 5, the lower, inner handle section 14 can terminate in a pivotal coupler 36*a* which can form part of flexible joint 38. The flexible joint 38 can facilitate rotation of the trowel blade receiving assembly 20 with respect to one or another of the handle sections 12, 14, as discussed in more detail below. While the operator manipulates upper handle 40 with his or her right hand (in this example), the operator can grasp the lower handle 42 with his or her left hand, resulting in rotation of the flexible joint, and thus rotation of the trowel blade receiving assembly.

As shown in FIG. 6, lower handle 42 can be rigidly coupled to outer, lower handle section 12 by way of threaded nut 33 and receiver 35. In this manner, the outer, lower handle section (to which the lower handle 42 is secured) can be maintained in position relative to the inner, lower handle section 14 to allow the operator to rotate and otherwise manipulate the trowel blade 22 of the trowel blade receiving assembly. Position of the lower handle 42 along the handle section 12 can be adjusted by releasing threaded nut 33 and repositioning the receiver 35 along the length of the outer, lower handle section 12.

While the position of the lower handle 42 relative to handle section 12, and the coupling of the upper handle 40 to handle portion 30, and the position of upper handle portion 30 to lower handle section 14 are shown in the figures by threaded nuts engageable over collars having finger engagement portions attached thereto, it is to be understood that each of these adjustment mechanisms can be provided in a number of manners known to those having ordinary skill in the art. For example, it is contemplated that lever-actuated clamping mechanisms can be utilized to provide the adjustable attachment of such components, and other similarly actuated devices that perform equivalent functions.

Operation of the flexible joint 38 is shown in more detail in exploded view in FIG. 4. As will be appreciated, pivotal coupler 36*a* can be rigidly coupled to inner, lower handle section 14 (which is rotated by an operator via upper handle 40). Pivotal coupler 36*a* can be pivotally attached to pivotal coupler 36*b* by way of pivot 44 which allows rotation of each of the pivotal couplers about one axis of rotation. Pivotal coupler 36*b* can be rigidly coupled to receiving prong 46 which receives the trowel blade receiving assembly 20. Thus, as the inner, lower handle section is rotated by an operator, the trowel blade receiving assembly is rotated about axis of rotation 110 (as shown in FIG. 2), which can be oriented at an angle from longitudinal axis 18.

The flexible joint 38 can be enclosed by outer sleeves 48*a* and 48*b* which form an angled enclosure conduit in which the flexible joint can rotate (note the outer sleeves are shown in FIG. 4 as removed, upwardly and downwardly from the flexible joint in order to clearly illustrate the features of the sleeves and the joint). The outer sleeves can each include a protrusion 50 which can mate within one of a pair of notches 52 formed in the outer, lower handle section 12. The outer sleeves can also be joined together by fasteners inserted through ports 54, as would occur to one skilled in the art. In this manner, the outer sleeves can be immovably held with respect to the flexible joint, allowing an operator to rotate the flexible joint, and thus the trowel blade assembly 20 and blade 22, while operating the upright trowel.

Figure 2:
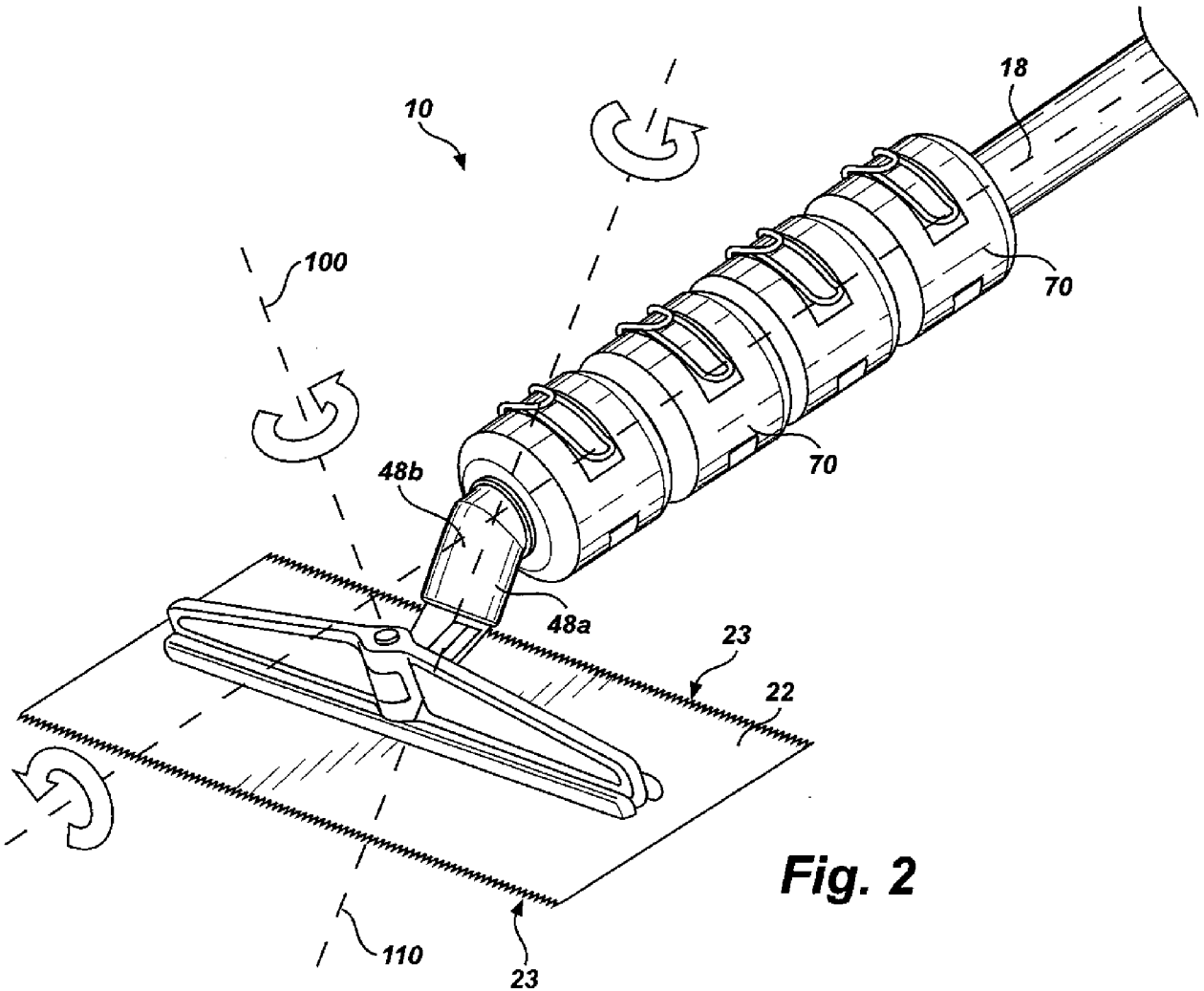
FIG. 2 is a more detailed view of a trowel blade receiving assembly and trowel blade of the upright trowel of FIG. 1.
Figure 3:
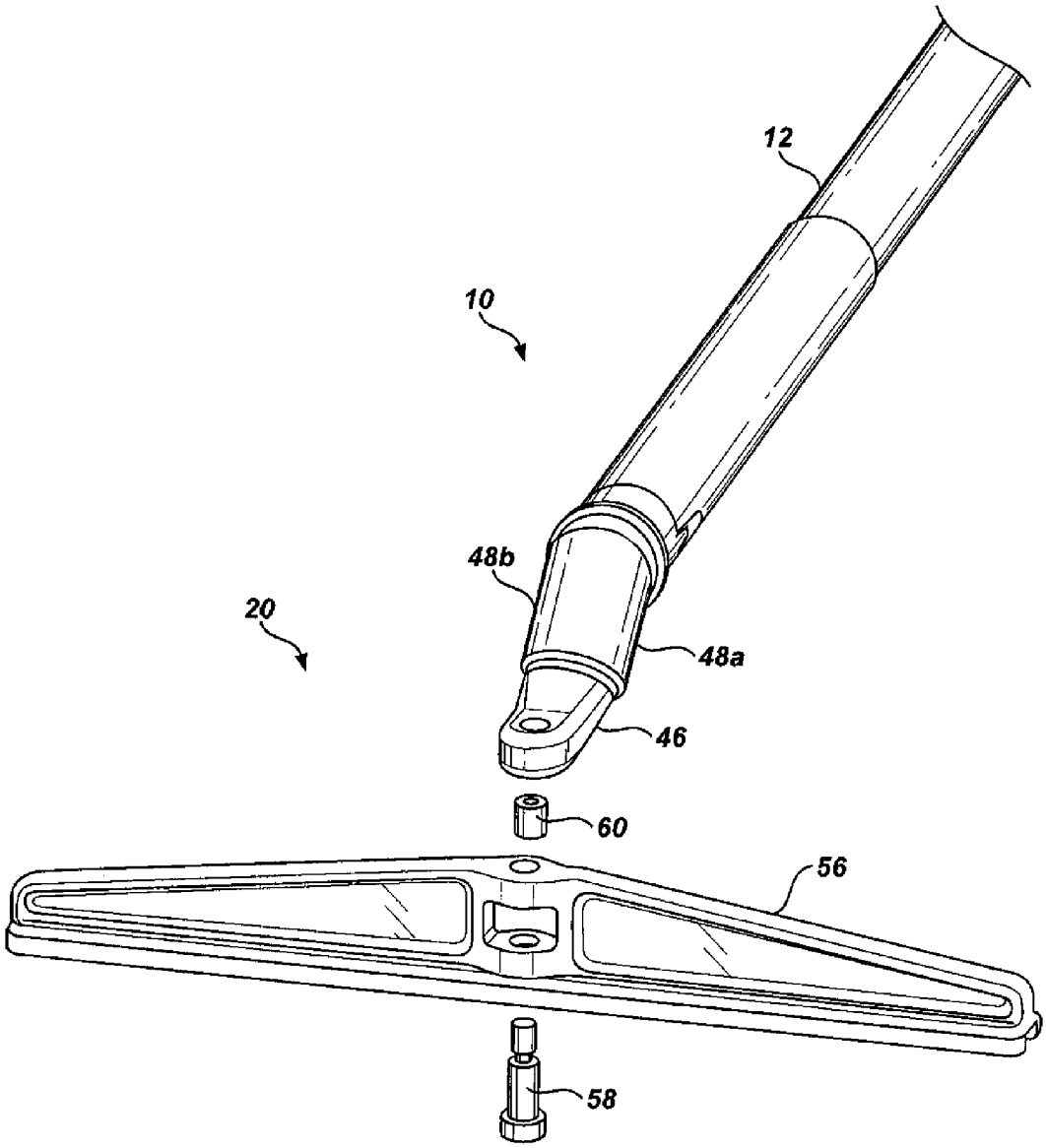
FIG. 3 is a partially exploded view of the trowel blade receiving assembly of FIG. 2.

The trowel blade receiving assembly is illustrated in more detail in FIG. 3 (wherein the trowel blade of FIGS. 1 and 2 is omitted for clarity). In addition to the receiving prong 46, the trowel blade receiving assembly can include blade support 56, a fastener 58 and a spacer 60. In this aspect of the invention, the blade support is attached to the receiving prong via fastener 58 and is at least partially restrained from movement by spacer 60. The blade support can rotate about the fastener and spacer to provide an additional axis of rotation to the trowel blade (as illustrated by axis 100 in FIG. 2). In addition to providing rotation about the axis 100, it has been found that, by providing more clearance than might otherwise be needed between the receiving prong and the blade support, the blade support can move with a greater degree of freedom on the shaft of the fastener 58. In this manner, an operator can be given in more control over manipulation of the trowel blade. It has been found that providing an additional 30 degrees of free angular rotation to the interface between the receiving prong and the blade support can aid sufficiently to enable an operator to accurately manipulate the trowel.

Figure 7:
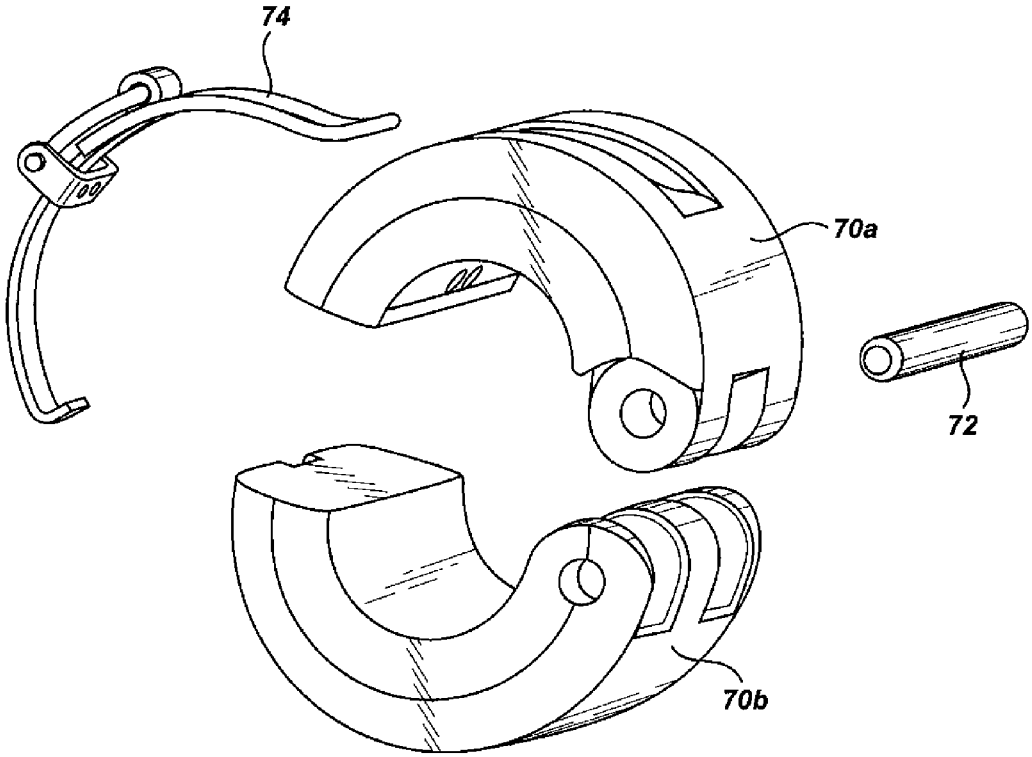
FIG. 7 is an exploded view of a weight disposable over the handle of FIG. 1.

As illustrated in FIGS. 1, 2 and 7, in one aspect of the invention the trowel can include at least one weight 70 operably disposable upon the handle of the trowel device. In the embodiment shown, one or more weights can be operably disposed over the outer, lower handle section 12. The weight can apply a floorward force (e.g., a force directed toward the floor) to aid an operator in retaining the trowel blade 22 of the trowel blade receiving assembly 20 in contact with a flooring surface (not shown) on which the trowel is being used. As best seen in FIG. 7, the weight can include two clam-shell halves, 70*a* and 70*b*. The halves can be secured to one another by removable pin 72 and clasp 74. In this manner, the weights can be incrementally added to or removed from the lower handle section to add or remove weight from the trowel blade. In one aspect of the invention, the weights are provided in 2.5 pound increments. It has been found that positioning the weights along longitudinal axis 18 can allow the weights to aid the operator in maintaining the trowel blade on the floor surface without significantly or negatively increasing the effort required by the operator to manipulate the trowel blade.

While not shown in the figures, it is contemplated that the present invention can incorporate structure that aids an operator in maintaining a desired position of the trowel blade relative to the handle. For example, biasing structure can be coupled between opposing sides of the trowel blade and the handle to aid in maintaining the trowel blade in a "null position," e.g., wherein each side of the trowel blade is equally spaced from the handle. This aspect of the invention can be advantageous when a significant amount of weight has been added to the handle for a particular application.

In addition to the structural components addressed above, the present invention also provides a method of spreading flooring material from an upright position, comprising: engaging flooring material disposed on a flooring surface with a trowel blade coupled to an upright trowel device; grasping a first elongate handle section of the upright trowel device to thereby control an angle between a handle of the trowel device and the flooring surface; and grasping and rotating a second elongate handle section of the upright trowel device to thereby alter a relative angle between the trowel blade and the handle of the trowel blade device. The first and second elongate handle sections can be rotatable with respect to one another about a common longitudinal axis to allow rotation of the trowel blade by an operator in an upright position.

In accordance with another aspect of the invention, the method can further include adjusting an overall length of the trowel device to correspond to a size of the operator in the upright position.

In accordance with another aspect of the invention, the method can further include coupling at least one weight to the trowel device to apply a floorward force to the trowel blade to aid in retaining the trowel blade in contact with the flooring surface during upright operation of the trowel.

In accordance with another aspect of the invention, coupling at least one weight to the trowel device can further include opening an openable collar on the at least one weight and disposing the weight over a side of the handle.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

The invention claimed is:

1. A trowel device for use by an operator in an upright position, comprising:

a trowel blade receiving assembly;

a first elongate handle section, operably coupled to and extending away from the blade receiving assembly toward a proximal end of the device; and a second elongate handle section, rotatably fixable with respect to the first elongate handle section and extending away from the blade receiving assembly toward the proximal end of the device;

the first handle section being rotatable with respect to the second handle section about a longitudinal axis common to each of the handle sections to allow the operator to adjust an angle of a trowel blade of the trowel blade receiving assembly while the operator is an upright position;

wherein the second elongate handle section includes a length at least about ⅓ of an overall length of the trowel device.

2. The device of claim 1, wherein one of the first and the second elongate handle sections extends at least partially through another of the first and second elongate handle sections.

3. The device of claim 2, wherein the second elongate handle section at least partially circumscribes the first elongate handle section.

4. The device of claim 1, further comprising means for longitudinally adjusting an overall length of the trowel device to allow the operator to tailor the length of the device to a size of the operator.

5. The device of claim 1, further comprising at least one weight coupleable to the trowel device and operable to apply a floorward force to the trowel blade receiving assembly, the weight being configured to aid an operator in retaining a trowel blade of the trowel blade receiving assembly in contact with a flooring surface during operation of the trowel device.

6. The device of claim 5, wherein the weight includes an openable collar configured to be opened to allow the weight to be disposed over a handle of the trowel device from a side of the handle.

7. A method of spreading flooring material from an upright position, comprising:

engaging flooring material disposed on a flooring surface with a trowel blade coupled to an upright trowel device;

grasping a first elongate handle section of the upright trowel device to thereby control an angle between a handle of the trowel device and the flooring surface; and grasping and rotating a second elongate handle section of the upright trowel device to thereby alter a relative angle between the trowel blade and the handle of the trowel blade device;

the first and second elongate handle sections being rotatable with respect to one another about a common longitudinal axis to allow rotation of the trowel blade by an operator in an upright position.

8. The method of claim 7, further comprising adjusting an overall length of the trowel device to correspond to a size of the operator in the upright position.

9. The method of claim 7, further comprising coupling at least one weight to the trowel device to apply a floorward force to the trowel blade to aid in retaining the trowel blade in contact with the flooring surface during upright operation of the trowel.

10. The method of claim 9, wherein coupling at least one weight to the trowel device comprises opening an openable collar on the at least one weight and disposing the weight over a side of the handle.

* * * * *